US007866013B2

(12) United States Patent
Laurens

(10) Patent No.: US 7,866,013 B2
(45) Date of Patent: Jan. 11, 2011

(54) URN AND A METHOD FOR FORMING A BODY THAT COMPRISES POWDERY MORTAL REMAINS

(76) Inventor: Wouter Klaas Jan Laurens, Berkenlaan 15, Wageningen (NL) NL-6706 DM ( * ) Notice: Subject to any disclaimer, the term of this patent is extended or adjusted under 35 U.S.C. 154(b) by 292 days.

(21) Appl. No.: 12/160,082

(22) PCT Filed: Jan. 5, 2007

(86) PCT No.: PCT/NL2007/000006

§ 371 (c)(1),
(2), (4) Date: Jul. 3, 2008

(87) PCT Pub. No.: WO2007/081200

PCT Pub. Date: Jul. 19, 2007

(65) Prior Publication Data

US 2009/0013513 A1 Jan. 15, 2009

(30) Foreign Application Priority Data

Jan. 9, 2006 (NL) ..... 1030872
Sep. 8, 2006 (NL) ..... 1032462

(51) Int. Cl.
*A61G 17/00* (2006.01)

(52) U.S. Cl. ..... 27/1

(58) Field of Classification Search ..... 27/1; D99/5; 441/32; 220/601, 661, 560
See application file for complete search history.

(56) References Cited

U.S. PATENT DOCUMENTS

| | | | | |
|---|---|---|---|---|
| 3,732,602 | A * | 5/1973 | Vigh | 27/1 |
| 6,041,483 | A | 3/2000 | Burch | |
| 6,382,111 | B1 | 5/2002 | Hojaji | |
| 6,516,501 | B2 * | 2/2003 | Vazquez-Perez | 27/1 |
| 2006/0179623 | A1 * | 8/2006 | Robinson | 27/1 |

FOREIGN PATENT DOCUMENTS

| | | | |
|---|---|---|---|
| DE | 20 2005 005 267 | U1 | 7/2005 |
| GB | 1420983 | A | 6/1976 |
| JP | 08107916 | A | 4/1996 |
| JP | 11155918 | | 6/1999 |
| WO | 2004/084788 | A1 | 10/2004 |

* cited by examiner

*Primary Examiner*—William L. Miller
(74) *Attorney, Agent, or Firm*—Shewchuk IP Services, LLC; Jeffrey D. Shewchuk

(57) ABSTRACT

A new type of urn has an inlet opening for water and an opening for the discharge of the water with powdery mortal remains, the opening being situated lower than the inlet opening. Ashes are introduced in the urn, for instance, in the form of a body comprising powdery mortal remains (ashes) and a binder, where the binder is selected from a water-soluble binder and an agent that disintegrates under the influence of water. The mortal remains are introduced into the earth under the influence of (rain) water. The invention also relates to a method for making such a body.

15 Claims, 3 Drawing Sheets

URN AND A METHOD FOR FORMING A BODY THAT COMPRISES POWDERY MORTAL REMAINS

CROSS-REFERENCE TO RELATED APPLICATION(S)

This is a national phase application filed under 35 U.S.C. §371 of PCT/NL2007/000006, filed Jan. 5, 2007.

BACKGROUND OF THE INVENTION

The present invention relates to an urn, as well as to a method for forming a body comprising powdery mortal remains.

In time, with both the traditional interment using a coffin as with cremation, where the ashes are kept in an urn, the problem arises of what to do with the mortal remains. For instance, in many cases graves have to be cleared away in time. This problem does not arise with cremation where the ashes are scattered. However, in that case the relatives lack a commemoration site specifically for their deceased, which makes the grieving process more difficult.

DESCRIPTION OF THE RELATED ART

JP 08/107 916 discloses an urn that is designed for the disposal of ashes of a deceased person into the sea. The urn comprises a narrow opening for slowly letting in seawater at its underside, and a narrow opening for letting out air at its upper side. The urn is made of a non-durable material and succumbs to the seawater in a couple of days and as a result of this the contents of the urn are released into the sea. The opening at the underside is not an opening for the discharge of the ashes.

BRIEF SUMMARY OF THE INVENTION

The object of the present invention is to provide an urn from which the mortal remains disappear over a period of time, as a result of which an empty urn is eventually all that remains.

To this end, the invention provides an urn that has an inlet opening for water, and an opening for the discharge of the water with the powdery mortal remains, said opening being situated lower than the inlet opening.

Such an urn is suitable for outdoor placement, and can thus optionally be placed outside over a period of time, wherein rain water or water that is added manually causes the mortal remains placed in the urn to be discharged into the ground via the discharge opening which is preferably situated at the underside of the urn. The urn is suitable for both human mortal remains and for the mortal remains of animals, in particular pets such as dogs and cats.

In practice, it will be preferred that the powdery mortal remains are introduced into the earth below ground level. To this end, according to a first embodiment, the urn is at its underside designed to be connected to a discharge pipe for the discharge of water with mortal remains via the opening for the discharge thereof.

To this end, the urn is for instance provided with a flange, a male part or a female part, said flange or port comprising the opening at the underside and can be connected to a discharge pipe that is to be inserted into the ground. The length of the pipe will determine the depth at which the mortal remains are released into the ground. This discharge pipe will in practice have a length of at least 30 cm, such as at least 1 m. The discharge pipe itself can function as an anchorage for the urn that is connected to the pipe, or be provided with a foundation or the like in which the discharge pipe is anchored.

According to an alternative non-preferred embodiment, the urn is at its underside provided with a discharge pipe for the discharge of water together with mortal remains via the opening for the discharge thereof.

The discharge pipe attached to the urn can be inserted in a hole in the ground. The length of the discharge pipe will be as indicated above.

Preferably, the opening for the discharge of water with mortal remains is a releasable closed opening.

Consequently, the discharge opening is hidden from view when the mortal remains are placed into the urn. The releasable closed opening preferably has a shape that is adapted to the shape of a pressed body comprising mortal remains, as will be discussed farther on in this application. Generally, the shape will preferably be concave, as can be seen at the interior of the urn.

Preferably, the urn has on its outer surface a protruding element for guiding water to the inlet opening for water.

Thus, using only a few and/or relatively small openings, sufficient water can be supplied for the discharge of the mortal remains.

Preferably, the protruding element hides the interior from view via the inlet opening for water of the urn.

According to a preferred embodiment, the urn comprises an organ for releasing water batch-wise, and preferably a reservoir and a siphon.

Herewith, a relatively large amount of water can be brought in contact with the mortal remains instantaneously, and the entrainment of the insoluble particles is enhanced. The siphon is fed by a reservoir that may be formed by the protruding element, or it can be a separate reservoir. The reservoir can be situated inside and/or outside the wall of the urn. For a proper functioning of the siphon it may be necessary to ensure that the lumen of the urn is in open contact with the atmosphere. For a reservoir placed in the lumen, which is fed by means of a inlet opening for water above it, i.e. situated higher, a separate opening in the urn will not be necessary. The use of a siphon also facilitates dividing the water flow from the siphon, and thus controlling the distribution of water inside the urn.

The invention also relates to a method for forming a body comprising powdery mortal remains.

Thus, the present invention also provides a method for forming a body comprising powdery mortal remains, wherein the powdery mortal remains are formed into the body using a binder, wherein as the binder at least a binder selected from the group a) water soluble binder, and b) an agent that disintegrates under the influence of water, is used.

According to a preferred embodiment, salt is used as the binder.

By choosing the type of salt, also including a mixture of salts, the rate at which the body solubilizes and/or falls apart under the influence of water can be controlled.

According to a suitable embodiment, the salt comprises sodium chloride.

According to a preferred embodiment, by using pressure the powdery mortal remains and the binder are formed into a pressed spherical body.

Preferably, the pressed body has the form of a sphere. The spherical shape contributes to that the body will always be situated at the bottom of the urn, in particular near the discharge opening thereof, as a result of which water disappearing from the urn via the discharge opening passes the body and thus can entrain powdery mortal remains.

According to an alternative embodiment, a body is formed by mixing a binder with the powdery mortal remains and by heating the mixture in order to melt the binder, after which the totality is cooled to below the melting point of the binder, to yield the body.

A preferred binder is a water soluble polymer, and in particular polyvinylstearylether, for instance Special Wax 2826 having a drop melting point of 55-65° C. (Kahl & Co, Trittau, Germany).

A further possibility for controlling the rate at which the powdery mortal remains are discharged from the body in the urn, is to coat the body with a water soluble coating.

As a water soluble coating, a water-soluble polymer may, for instance, be used. In such a case the coating will generally be chosen such that it dissolves with more difficulty than the binder with which the powdery remains are mixed.

A body comprising powdery mortal remains and a binder, wherein the binder is selected from a water-soluble binder and an agent that disintegrates under the influence of water. The body is for instance a pressed body. All embodiments of the body can be produced with the method according to the invention.

Finally, the invention relates to a method for the disposal of ashes, which is of importance for crematoria and the like. The method is characterized in that water is fed to an urn according to the invention, which urn contains ashes.

Feeding may take place by placing the urn in the open air, where rainwater may cause the ashes to be discharged. Alternatively, or additionally, water can be supplied to the urn artificially. In that case, placing the urn in the open air is not important. Artificially supplied water may also be rainwater.

BRIEF DESCRIPTION OF THE DRAWINGS

The invention will now be illustrated with reference to the drawings, in which.

DETAILED DESCRIPTION

Figure 1:
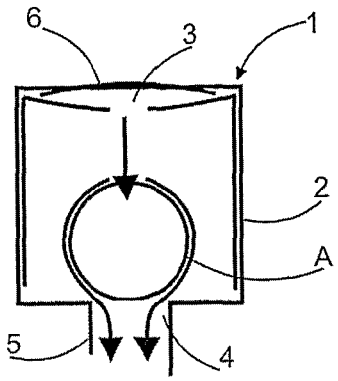
FIG. 1 shows a cross section of an urn according to the invention, in which a body, produced using the method according to the invention, has been placed.

In FIG. 1 a first embodiment of an urn according to the invention is shown. As shown, a body A comprising powdery mortal remains, such as in particular ashes, has been placed in the urn 1. In order to obtain the mortal remains in a powdery state, these can be reduced after the cremation, which is not unusual, by using for instance a ball mill. The particle size of the ashes is preferably reduced such, that the largest dimension is 4 mm or smaller. Here, the body A has a spherical shape but it may in fact have any shape. The body A may comprise the ashes of 1 or more persons (or animals). Also, instead of 1 body A, several bodies A may be present, which may contain the mortal remains of optionally various persons (or animals). The variety of means with which such bodies A can be made will be dealt with later. First, the functioning of the urn will be elucidated further.

The urn 1 comprises a housing 2 provided with a hole 3. This hole 3 allows the passage of water that falls on the housing 2. In the embodiment shown, this water then falls on the body A. The water solubilizes part of the body A, and exits the urn 1 via a discharge opening 4. Insoluble particles or particles that solubilize poorly are entrained by the water. Thus, over a period of time the body A will disappear from the urn. Unlike a garden of rest for the scattering of ashes, the urn gives a crematorium the opportunity to provide the relatives with a personal site where the deceased can be commemorated, without an elapsing time limit after which the crematorium has to contact relatives to ask them what to do with the ashes, as is the case for walls in which urns are kept. The urn according to the invention also offers the relatives the possibility to place the urn in the garden, without burdening later generations with the problem of what to do with the mortal remains.

The solubilized and/or entrained mortal remains leaving the urn via the discharge opening 4, will end up on or preferably in the ground. To this end, the discharge opening 4 is preferably connected to a discharge tube 5, which can be connected to the urn 1 in any known manner. The discharge tube 5 may also be an integral part of the urn 1, but this will not be preferred.

For that matter, it is preferred that the internal volume of the discharge tube 5 is such, that a relatively large amount of water can be held since it is generally not preferred that the urn 1 fills up with water. This could, for instance, occur during sprinkling the garden, where one forgets to cease the sprinkling. If desired, the wall of the discharge tube 5 may be provided with one or more holes for the discharge of liquid from the discharge tube 5 to the ground.

The water can be rain water as well as artificially applied water. The disappearance of the mortal remains from the urn 1 can thus be accelerated, if desired, even when the urn has been closed in such a way that it cannot be reopened. Generally, it will be desired that the non-soluble mortal remains end up at a depth at which they do not resurface as a result of digging and the like. Hence, a suitable length of the discharge tube 5 is for instance at least 1 m.

FIG. 1 schematically shows the water flow over the body A, although it is noted that for the full disappearance of the body A from the urn 1, a feeding of water against the body A at more than 1 place, is deemed favourable.

Generally, it will be desired to hide the body A from view. To this end, a shielding 6 is provided which, in the embodiment shown in FIG. 1, collects the rainwater.

Figure 2:
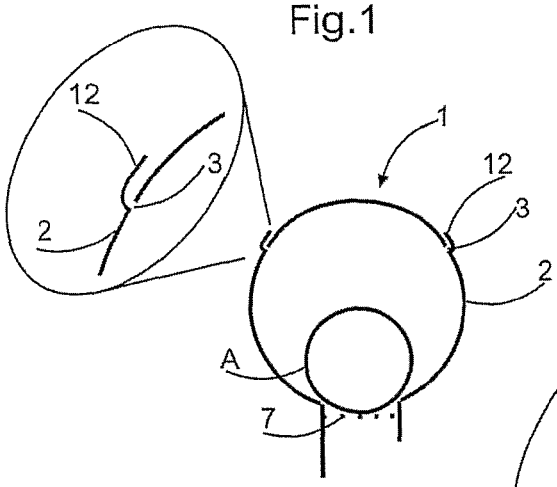
FIG. 2 shows a cross section of an alternative urn according to the invention, in which a body, produced using the method according to the invention, has been placed.
Figure 3:
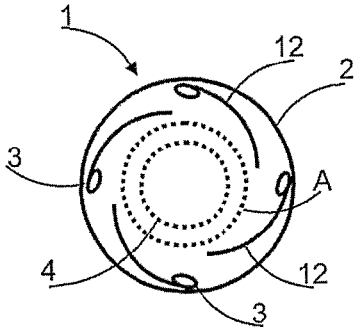
FIG. 3 shows a top plan view of the urn shown in FIG. 2.

FIGS. 2 and 3 show an alternative embodiment of an urn 1 according to the invention. The urn 1 is provided with 4 holes 3 (see the top plan view in FIG. 3 also). In this case, the water flows along the interior of the housing 2 and reaches the body A from various directions. Since it may not be desirable that the last remainder or remainders of a body A that has been eroded for the greater part leaves the urn in one go via the discharge opening 4, the discharge opening 4 may take the form of a sieve, or be provided with a sieve 7. It goes without saying that the mesh size of such a sieve 7 has to be such that even the largest non-soluble particles of the mortal remains may still be discharged via the sieve 7.

The embodiment of the urn 1 shown in FIGS. 2 and 3 is provided with guides, here in the form of upright edges 12, for transporting the water, which ends up on the upper side of the urn 1, to the holes 3. This detail is shown enlarged in FIG. 2.

Figure 4:
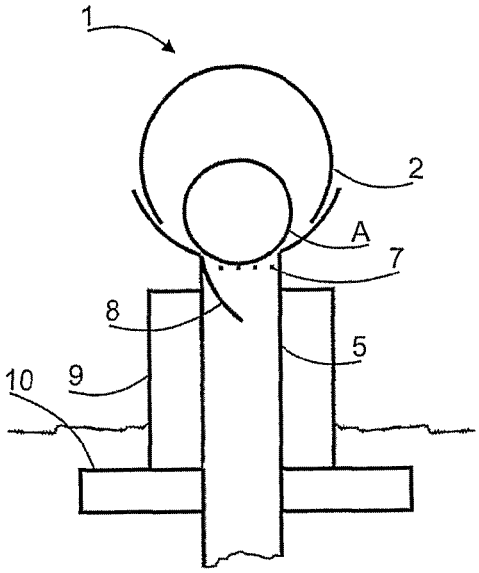
FIG. 4 shows a cross section of an alternative embodiment of the urn of FIG. 2, wherein the urn is provided with a pipe.

FIG. 4 shows an urn 1 that is provided with a cover 8 with which the discharge opening 4 can be closed until after the placing of the urn 1, and in particular until after closing it, so that the person who places the body A in the urn 1 will not see the discharge opening 4 and/or the discharge tube 5. The cover 8 is preferably designed such that it can be opened after placement of the urn 1. This may for instance take place as a result of gravity, or by a spring, by removing a locking.

FIG. 4 also shows that the urn 1 can be placed on a base 9, which will generally be founded using foundation 10.

Finally, FIG. 4 shows that, when guides 12 are used and the outer surface of the urn is of a material over which water drops may run thanks to adhesion, the holes 3 can also be situated in the lower half of the urn 4. For that matter, the holes 3, do not have to be situated at the same height. For a proper distribution of water in the urn 1 in order to effectively erode the body A, it may be favourable when in the upper part of the urn 1 one or more holes 3 are present through which water falls onto the body A, while holes 3 provided at a lower location in the housing 2 of the urn 1 cause the feeding of water via the inner wall of the urn 1.

Figure 5:
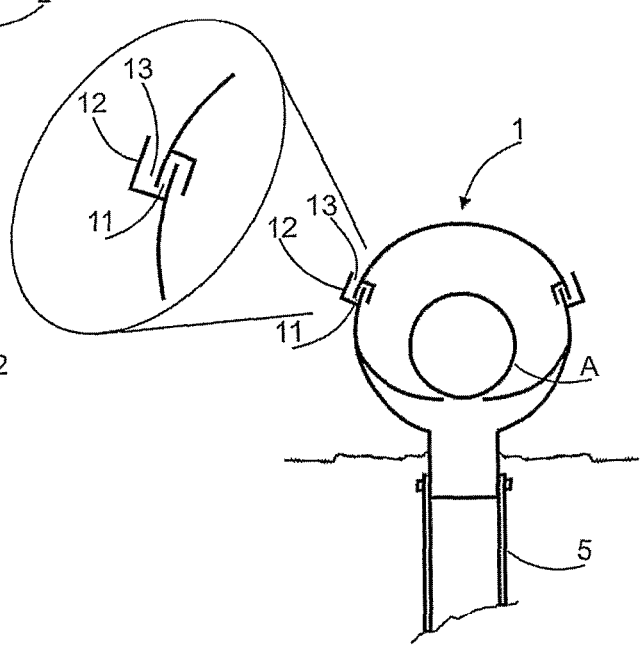
FIG. 5 shows a cross section of an alternative embodiment of the urn of FIG. 4, wherein the pipe is incorporated in a base.

FIG. 5 shows some optional modifications to the urn 1 which may be employed separately. Firstly, one should realize that the body does not necessarily have to be situated on the bottom of the housing 2. Further, this embodiment shows that the urn 1 may be provided with 1 or more siphons 11. These cause a relatively large amount of water to be fed to the body A instantaneously. This makes it easier to entrain non-soluble particles and to avoid any depositing of solubilized material of the body A (for instance as a consequence of evaporation). In the embodiment shown here, the upright edges 12 are dimensioned such that a reservoir 13 is formed, which is emptied via the duct of siphon 11 when it is full. This detail is shown enlarged in FIG. 5. The siphon 11 and/or the reservoir 13 can be situated at the outside of the urn 1, in the lumen or, as shown in FIG. 5, be integrated in the wall of the housing 2.

Figure 6:
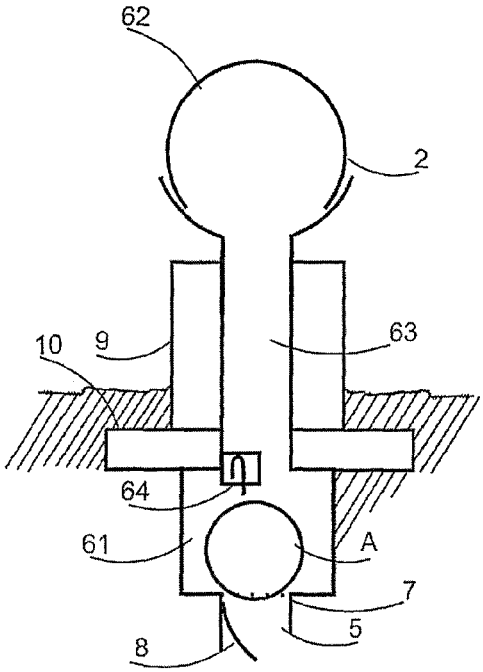
FIG. 6 shows an alternative embodiment of the urn of FIG. 5, wherein the lumen in which the mortal remains are placed, is situated below the surface of the earth.

In some countries, such as Germany, it is currently not permitted to keep mortal remains above the ground. FIG. 6 shows an urn according to the invention which meets this requirement by providing urn 60 which comprises a lower chamber 61 and an upper chamber 62. The mortal remains are placed in the lower chamber 61. The chambers 61, 62 are connected with each other via a feeder pipe 63 for the feeding of water which falls on the upper side of the urn 60, i.e. the upper chamber 62. A reservoir 64 with siphon may be situated, as desired, outside, inside or integrated in the wall of the upper chamber 62, be incorporated in the feeder pipe 63 or, as for the upper chamber 62, at the level of the lower chamber 61. In the embodiment shown here, the reservoir is situated in the urn at the transition between the feeder pipe 63 and the lower chamber 61.

Figure 7:
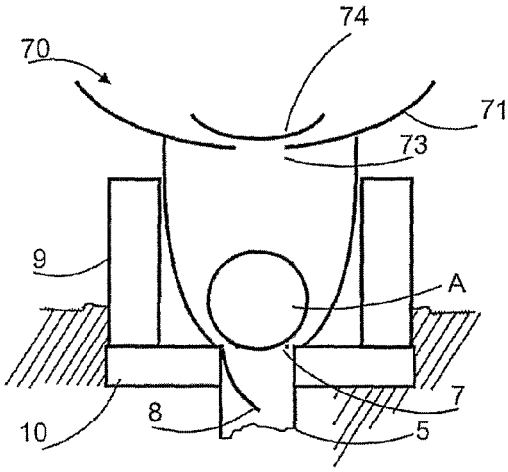
FIG. 7 represents an alternative embodiment of an urn according to the invention.

FIG. 7 shows an alternative embodiment of the urn according to the invention, and more specifically an urn 70, which at the upper side is provided with a water-collecting organ 71 in the shape of a bowl, which is designed concavely with its open side at the top. An opening 73 providing access for the water collected by the water collecting organ 71 is largely hid from view by a saucer 74 which functions as a water bowl for birds. A reservoir with siphon may for instance be situated in the lumen of the urn 70, but may alternatively also be integrated with the water-collecting organ 71.

In general, when a reservoir with siphon is situated at the outside of the urn or is integrated in its wall, it is easy to maintain—in particular remedy any clogging by, for instance, leaves. However, this problem can already be largely avoided by not positioning the lowest point of the siphon in the reservoir near the lowest point of the reservoir (compare the reservoir of FIG. 9 with that of FIG. 5, wherein that of FIG. 5 thus is not preferred).

The body A may for instance be manufactured by mixing powdery mortal remains with a salt, such as kitchen salt, and by subsequently compressing this mixture under high pressure. Alternatively, a binder can be melted and the powdery mortal remains are mixed with the melted binder, after which the melt is cooled. The way in which the body A is formed is not crucial, as long as the binder that is used is water soluble or water dispersible. For the manufacture of the body A, reference can be made to known techniques for manufacturing candy products and pharmaceutical methods for making tablets and the like (Remington's Pharmaceutical Sciences, Mack Publishing Co., Easton, Pa.). These known techniques are usable, even though the body A is larger. In the case where the binder is biodegradable, it may be desirable to avoid its metabolization in the urn. This may for instance be achieved by intermixing sufficient amounts of salt.

Forming powdery mortal remains into a body can be achieved in many various ways. Special Wax 2826 (Kahl & Co, Trittau, Germany) can be heated up to 75° C. or higher, as a result of which the wax will melt. Next, the ashes may be stirred homogeneously into the warm wax mixture and cast into the desired shape, such as a sphere. Alternatively, the ashes can be heated to 100° C. and mixed with powdery Special Wax 2826, after which the assembly can be pressed into the desired shape.

In general, it should noted that the time necessary to discharge the powdery mortal remains can be regulated within extremely broad limits. This rate depends on the amount of water fed which, with respect to rain water, depends on the regime of precipitation, the effective surface area collecting precipitation, the number, size and arrangement of the holes, and the use of guiding systems for transporting the water to the holes. Further, the rate depends on the used binder, the amount of binder, the use of auxiliary agents, such as agents that promote the disintegration of the body etc., the water solubility of the binder used etc. Thus, a very slow discharge of the mortal remains from the urn can be chosen, for instance, over a period of several years. On the other hand, it is also possible to cause the process to proceed rapidly (for instance by using an urn designed for this purpose), and optionally, by feeding (pouring, sprinkling etc.) water to the urn oneself.

The water-soluble coating may contain further components, such as pigment or colorants. Examples are titanium dioxide, to provide a bright white colour, metal particles, to provide a metal gloss, and colorants.

Instead of forming a body that comprises the powdery mortal remains, the urn according to the invention may also comprise a container which contains the powdery mortal remains in a powdery state, which powdery mortal remains are released from the container. The container may be integrated with the urn, that is to say that at least one part of the wall or walls forming the container belong to the outer wall of the urn. Alternatively, the container may be included in the urn as well. An embodiment of this possibility is shown in FIG. 8, and the container is shown in detail in FIG. 9.

Urn 80 contains a container 81. The container 81 having a conical lower end, has at its lowest point an opening 82 for the passage of the powdery mortal remains A placed into the container 81. The unimpeded emptying of the container 81 is counteracted by a surface 83 that is arranged at a small distance from the opening 82. Mortal remains will flow from the container 81, until the accumulation thereof between the surface 83 and the container 81 blocks the opening 82. When the discharge of the mortal remains takes place naturally, i.e. by means of rain water, the use of a reservoir with a siphon 85 will be recommended for most areas, because in that case the water which is fed via the siphon in a relatively large amount, will flush away the powdery remains between the surface 83 and the container 81 with force and volume. Next, powdery mortal remains will flow from the container 81 again. By making the surface part of a duct, a controlled water flow, directed at the ashes under the opening 82, can be achieved. In such a case the likelihood that ash remains spread inside the urn, is reduced.

Figure 8:
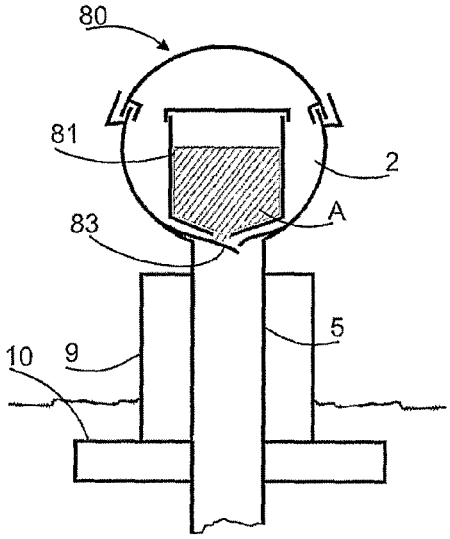
FIG. 8 shows an alternative embodiment of the urn according to the invention, suitable for mortal remains that have not been formed into a body.
Figure 9:
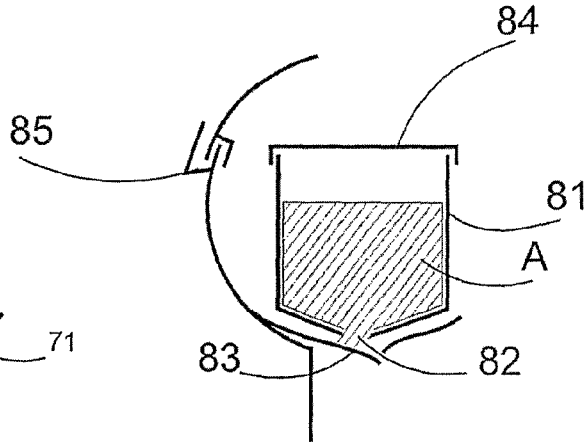
FIG. 9 shows a detail of FIG. 8.

In the embodiment shown in FIGS. 8 and 9 the container 81 has a conical lower side, which ensures that all powdery mortal remains can flow from the container 81. It goes without saying that the distance between the opening 82 (shown enlarged) and the surface 83 must be larger than the largest grain size in the powdery mortal remains. It will not suffice that the opening 82 is of such dimensions that it can let through grains of these size, yet it must also have such dimensions that bridge formation at the opening 82 will not lead to a blockage.

The container 81 may be closed with a cover 84.

Figure 10:
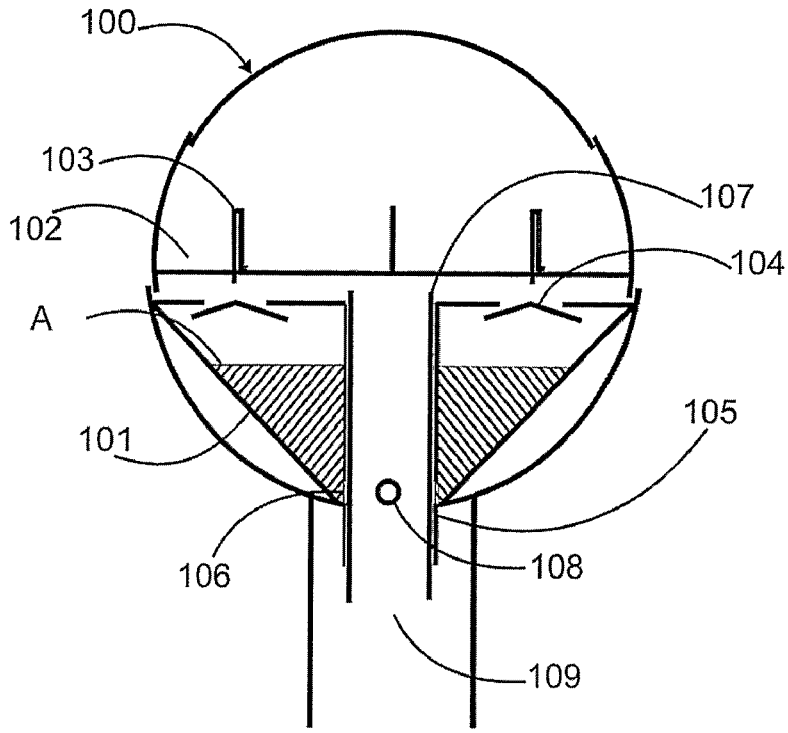
FIG. 10 shows a preferred embodiment of the urn according to the invention.

A preferred embodiment of an urn according to the invention is shown in FIG. 10. In urn 100 a container 101 is arranged in which the ashes A are placed. Strictly speaking a separate container 101 is not necessary, yet the advantage of using a container 101 is that the surface area which has to be cleared of ashes can be smaller, and can readily be formed such that the surface co-operates with the means for the feeding of water, as will be explained now. The urn 100 is further provided with a reservoir 102 with siphon 103. Water that is released when the siphon comes into action, flows on a distribution plate 104. This distribution plate 104 is suitably provided with guides (not shown) in the form of grooves, undulations or protruding elements (upright edges) for distributing the water over the ashes in the container 101. The container 101 is provided with a central hollow tube 105, which at the lowest point of the container 101 is provided with one or more holes 106. A second discharge tube 107, which is placed coaxially and fitting in (or optionally over) the hollow tube 105 closes the holes 106 in a first position. This is the position during which the ashes will be placed in the container 101. The hollow tube 107 will be turned, moved or removed axially in order to release the holes 106 as a result of which these come into open connection with the discharge opening 109 via holes 108 of the hollow tube 107. The size of the holes 106 is chosen (or adjusted by the degree of rotation/displacement of the second hollow tube 107) depending on the size of the ash particles. A suitable size of the holes 106 and 108 for ashes having a maximum dimension of 4 mm, is generally 4 to 12 mm. The batch-wise feeding of water allows the water applied onto the ashes to first entrain the ash particles through the holes 106 and subsequently through the discharge opening 109. The container 101 may be divided into compartments by means of substantially vertical walls. This is favourable, since this enhances the collapsing of the ashes and at the same time the proper discharge from the container 101. In that case, each of the compartments will be fed by a siphon 103 from a reservoir 102.

The powdery mortal remains may be mixed with an agent known per se for counteracting the formation of lumps, such as calcium carbonate or the like.

The urn may be manufactured from any durable material such as UV resistant plastic, hardwood, glass, ceramic material and metal or alloys thereof. Suitable materials are for instance stainless steel, bronze, aluminium, and corten steel. The urn may be designed such that it cannot be opened after it has been closed, or that it can only be opened using very specific tools. The housing will generally be constituted from two or more parts, yet this is not critical and the description and description of the figures above provide the practitioner with sufficient practical information to successfully work the invention. As will be clear to the person of ordinary skill in the art, the urn according to the invention is made of a durable material such that the life span of the urn is sufficient to discharge the ashes from the urn during the conditions under which the urn is used. Herewith the influences, such as wind force and UV, to which the urn may be exposed, will be taken into account as well as a sufficient water resistance. When placing the urn under a shelter or in a building these influences do not necessarily play a part. If water is only applied directly in the hole, the design of the urn only has to take into account the sufficient water resistance of the internal parts of the urn.

Water can end up in the urn according to the invention in 3 ways: Directly in the hole, on the outer surface of the urn and by sloping of the surface in a hole situated lower, or indirectly by a guiding organ such as an upright edge. In the latter case, the surface collecting the rain may be spherical without a problem, as can be seen in some of the working examples. A combination of 2 or all ways is possible. When designing an urn according to the invention, the designer thus has a great deal of liberty and can herewith control the rate at which the ashes are discharged under particular circumstances.

For a proper functioning of the urn, it will generally be desired to prevent the access of dirt (such as sand and in particular leaves which could clog the openings). This may be achieved in many ways, for instance by choosing the location of the holes, their dimensions, grates etc.

Generally, it will be be preferred to design the discharge opening 4 and a sieve 7 optionally placed below it such that water discharged will not come into contact with the inner wall of the discharge tube 5. This, in order to avoid the deposition of insoluble particles and optionally salt as a consequence of evaporation. When using a siphon 11 with which larger amounts of water are discharged instantaneously this is of less or is of no importance. In general, the urn 1 will be arranged such that it is designed to effectively discharge powdery mortal remains from the urn. The spherical shape described herein, or also the use of a tapered shape, contributes to that the body A or fragments thereof are forced towards the discharge opening 4.

Figure 11:
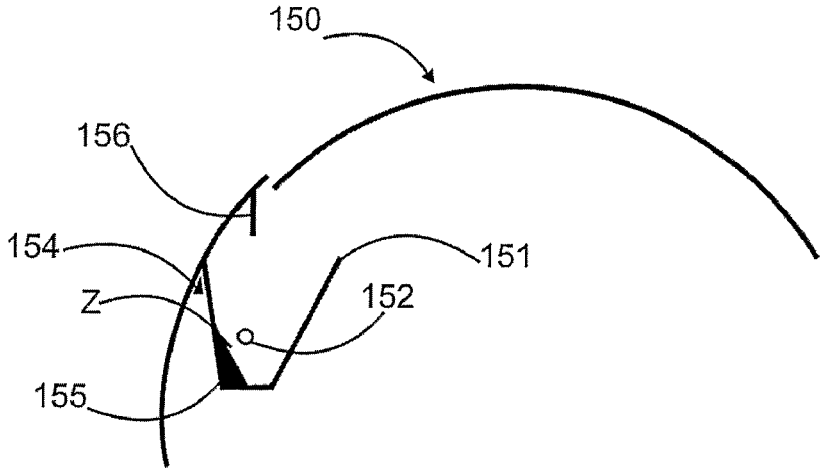
FIG. 11 schematically shows an organ for the batch-wise release of water.

For effectively flushing away the ashes it will often be preferred to bring the water in contact with the ashes batch-wise. Instead of a siphon, hereto also other organs that release water batch-wise can be used such as for instance a small overturning bucket which tips over when full and discharges water and after having discharged the water returns to its original position again as a result of a centre of gravity which lies lower than the pivot of the small overturning bucket. Nevertheless, from the perspective of reliability constructions like these, having moving parts, are not preferred. A possible embodiment of a small overturning bucket is shown in FIG. 11. Urn 150 (of which only a part of the wall is shown) is provided with a small overturning bucket 151, which is pivotable around an axis 152. In an empty state the centre of gravity is situated at Z. When the water level in the small overturning bucket 151 rises, the centre of gravity will be situated more to the right (in the figure; and higher). At a certain point, the small overturning bucket 151 will tip over and discharge at least part of its contents in one go. As a result of the discharge of a lot of water from the small overturning bucket 151, the centre of gravity will be situated at the left side of the axis again, and the small overturning bucket 151 will regain its original (indicated in FIG. 10) position, ready for collecting the next batch of water. In the embodiment of the small overturning bucket shown in FIG. 10, it is designed such that when little (or no) water is present in the small overturning bucket, it is pressed against an abutment 154. This has been achieved using a weighted wall 155. By using a filler body of for instance polystyrene, or a recess of the (here left) wall of the small overturning bucket 151, it can be arranged that the centre of gravity moves to the right very rapidly. A tab 156 ensures that water can still enter the small overturning bucket 151, even if the small overturning bucket 151 is somewhat askew.

Method for the disposal of ashes, wherein a hole having a depth of at least 0.5 meters is made in the face of the earth, an urn having an opening is placed above the hole such that the opening is situated above the hole, the urn has an organ blocking the ash flow, which retains the ashes in the urn in a first position and releases the ashes in a second position, and the organ is brought from the first position into the second position for placing the ashes into the hole via the opening of the urn. The hole preferably has a depth of at least 1 m, more preferably at least 1.5 meters, even more preferably at least 2 meters and most preferably at least 2.5 meters. Release may occur by tipping over, rotation or translation of the blocking organ, or a combination thereof. An example is the closing mechanism disclosed in FIG. 10. By using larger holes 106 the ashes can be released to the earth directly without water. The size of a hole closable by the blocking organ is such, that neither large ash particles nor bridge formation impede the discharge of the ashes at a unblocked hole. A suitable size is for instance at least 10 mm, preferably at least 15 mm, and more preferably at least 20 mm. A hole situated in a horizontal plane may be smaller than a hole situated in a plane that is at an angle with the vertical. Operating the blocking organ can take place in various ways, even (and preferably) without opening the urn. For instance, for an urn corresponding to that of FIG. 10 which, however, may be designed without a inlet opening for water, the hollow tube may be provided with teeth and be turned by means of a worm wheel, wherein the worm wheel is connected to a rod which protrudes to outside the urn. Alternatively, for instance also a battery driven (optionally actuated using a timer) small motor situated in the urn, can be used. It is also conceivable that the blocking organ is operated from outside using a magnet. To this end, the second hollow tube shown in FIG. 10 may be provided with an arm placed perpendicularly thereon, which at its end is provided with a little block of iron or a magnet. Besides the blocking organs provided in the urn, also blocking organs that block the discharge opening and can release it can be used. The invention also relates to an urn suitable for carrying out the method described above, which is provided with an organ blocking the ash flow, which organ retains the ashes in the urn in a first position and in a second position releases the ashes for discharging from the urn. The organ may also be operated by a small overturning bucket as indicated in FIG. 11, wherein the axis of the small overturning bucket or the small overturning bucket itself is mechanically connected with the blocking organ, and can release it when the small overturning bucket has collected sufficient (rain) water. It is favourable for all methods for the discharge of ashes according to the invention, but in particular for those wherein the ashes are not entrained by water, when after having placed the ashes in the urn, a layer of powdery (and thus capable of flowing) material is applied onto the ashes, such as sand. This helps to ensure that no or less ashes remain on the wall, discharge tube etc. The layer preferably has a thickness of at least 1, more preferably 2 and even more preferably at least 3 cm.

The invention claimed is:

1. Urn adapted for housing powdery mortal remains in an interior of the urn, said urn made of a durable material, said urn being provided with an inlet opening for water and a discharge opening for discharging water carrying the mortal remains, said discharge opening being situated lower than the inlet opening, wherein the urn comprises an organ for releasing water batch-wise for contact with at least a portion of the powdery mortal remains in the interior of the urn.

2. Urn according to claim 1, wherein the urn at its underside is designed to be connected to a discharge pipe for the discharge of water carrying the mortal remains through the discharge opening.

3. Urn according to claim 1, where the urn at its underside is provided with a discharge pipe for the discharge of water carrying the mortal remains via the discharge opening.

4. Urn according to claim 1, where the discharge opening is a releasably closed opening.

5. Urn according to claim 1, where the urn has an upper outer surface, and further comprising a protruding element for guiding water falling on the upper outer surface to the inlet opening for water.

6. Urn according to claim 5, characterized in that the protruding element hides the interior from view via the inlet opening for water of the urn.

7. The urn of claim 1, wherein the organ for releasing water batch-wise comprises a reservoir and a siphon.

8. The urn of claim 1, further comprising a mortal remains supporting structure within the interior of the urn.

9. Method for the disposal of mortal remains, comprising:

providing an urn having an interior containing the mortal remains, the urn being made of a durable material, the urn comprising:

an upper water receiving surface having a slope;

an inlet opening communicating with the interior of the urn, the inlet opening for water channeled downward on the slope of the upper water receiving surface to the inlet opening; and a discharge opening for the discharge of the water carrying the mortal remains, said opening being situated lower than the inlet opening; and feeding water into the urn by having the water fall on the upper water receiving surface and flow downward therefrom through the inlet opening into contact with at least a portion of the mortal remains, and thereafter through the discharge opening.

10. The method of claim 9, wherein the water carrying the mortal remains passes through the discharge opening into the earth below ground level.

11. The method of claim 10, wherein the water carrying the mortal remains passes through a discharge pipe, at least a portion of the discharge pipe being in the earth below ground level.

12. The method of claim 9, wherein the mortal remains are powdery mortal remains.

13. The method of claim 12, wherein the powdery mortal remains are ashes.

14. An urn having an interior adapted for housing mortal remains in a location generally concealed from view, the urn being made of a durable material, the urn comprising:

an upper water receiving surface having a slope;

an inlet opening communicating with the interior of the urn, the inlet opening receiving water channeled downward on the slope of the upper water receiving surface to the inlet opening;

a mortal remains supporting structure within the interior of the urn; and a discharge opening for discharging water carrying the mortal remains, said opening being situated lower than the inlet opening, wherein water received through the inlet opening contacts at least a portion of the mortal remains on the mortal remains supporting structure to carry at least a portion of the mortal remains through the discharge opening.

15. The urn of claim 14, wherein the urn has a generally spherical shape.

* * * * *